US005481284A

United States Patent [19]

Kitahara et al.

[11] Patent Number: 5,481,284

[45] Date of Patent: Jan. 2, 1996

[54] PRINTER HAVING LINE-TYPE INK JET RECORDING HEAD

[75] Inventors: Tsuyoshi Kitahara; Eiji Kumai; Hiromu Hirabayashi; Kenichi Kanbayashi; Kohji Watanabe, all of Nagano, Japan

[73] Assignee: Seiko Epson Corporation, Tokyo, Japan

[21] Appl. No.: 78,652

[22] Filed: Jun. 21, 1993

[30] Foreign Application Priority Data

| | | | |
|---|---|---|---|
| Jun. 23, 1992 | [JP] | Japan | 4-164951 |
| Jun. 23, 1992 | [JP] | Japan | 4-164952 |
| Sep. 24, 1992 | [JP] | Japan | 4-254885 |
| Oct. 12, 1992 | [JP] | Japan | 4-273145 |
| Oct. 13, 1992 | [JP] | Japan | 4-274508 |
| Oct. 19, 1992 | [JP] | Japan | 4-280095 |
| Mar. 29, 1993 | [JP] | Japan | 5-093672 |

[51] Int. Cl.[6] ..... B41J 2/155; B41J 2/18; B41J 2/19

[52] U.S. Cl. ..... 347/42; 347/89; 347/92

[58] Field of Search ..... 347/29, 84, 85, 347/89, 92, 71, 103, 40, 42

[56] References Cited

U.S. PATENT DOCUMENTS

| | | | |
|---|---|---|---|
| 4,106,032 | 8/1978 | Miura et al. | 347/21 |
| 4,737,801 | 4/1988 | Ichihashi et al. | 347/92 X |
| 5,231,424 | 7/1993 | Kaneko et al. | 347/89 |

FOREIGN PATENT DOCUMENTS

| | | |
|---|---|---|
| 0390198 | 10/1990 | European Pat. Off. . |
| 56-60256 | 5/1981 | Japan . |
| 59-123672 | 7/1984 | Japan . |
| 60-137655 | 7/1985 | Japan . |
| 61-11794 | 4/1986 | Japan . |
| 3-32853 | 2/1991 | Japan . |
| 3-164262 | 7/1991 | Japan . |
| 3-169564 | 7/1991 | Japan . |
| 3-187761 | 8/1991 | Japan . |
| 3-60672 | 9/1991 | Japan . |
| 2087314 | 5/1982 | United Kingdom . |

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

A printer using a line-type ink jet recording head. The line-type head has pressure producing chambers formed by dividing nozzle openings extending in a recording paper width direction with vertical side walls and upper and lower ink flow paths which communicate with each other through the pressure producing chambers and extend in a horizontal direction. Each ink flow path has an inlet for replenishing ink and an outlet for discharging the ink. A plurality of pressure producing elements are provided for applying varied pressures to the pressure producing chambers for jetting ink droplets. A sealing member selectively seals the nozzle openings by abutting on the nozzle openings when the recording head has been evacuated to a predetermined position. An ink tank is connected to the inlets and the outlets through pipes, and an ink stream producing device is arranged in the pipes, for producing streams causing the ink to flow from the ink tank to the lower ink flow path and then to the upper ink flow path through the pressure producing chambers.

26 Claims, 5 Drawing Sheets

PRINTER HAVING LINE-TYPE INK JET RECORDING HEAD

BACKGROUND OF THE INVENTION

The invention relates to a device for supplying ink to a line-type ink jet recording head having a plurality of nozzle openings arranged in a printing line direction.

Ink jet printers are extremely quiet compared to wire dot type printers and are less expensive to operate than thermal printers. However, ink jet printers, which jet ink droplets directly onto a recording medium, do not always produce high quality images because ink blots which occur on certain kinds of recording paper impair print quality. A thickener can be added to the ink in order to control blotting to some extent. The use of thickener, however, causes bubbles to stagnate in pressure producing chambers, insoluble substances to be deposited in pressure chambers and nozzles, nozzle openings to be clogged, etc., thus further deteriorating the performance of the printer.

On the other hand, to prevent the blots caused by directly jetting the ink onto the recording medium, a printer has been proposed in U.S. Pat. No. 4,538,156 which first transfers ink droplets onto a blot-free intermediate medium and thence to the recording paper a predetermined time after first receiving the jetted ink droplets on the blot-free intermediate medium.

If such a transfer technique is employed, recording can be made from the intermediate medium onto the recording paper after a solvent contained in the ink has been volatilized to some extent, thus allowing high quality prints to be obtained independently of the quality and type of recording paper.

However, the use of such a transfer technique extends the printing time because of the time required for printing on the intermediate medium. In addition, if the time difference between the printing of a first dot and the last dot on the intermediate medium becomes too long, the transfer performance becomes inconsistent due to large variations in the degree to which the solvent is dried. To overcome this problem, a line-type recording head having a plurality of nozzles arranged in the recording paper width direction to allow a line of data to be printed within a smallest possible time has been proposed.

However, ink used in the transfer type recording head must have an excellent film forming property and adhesiveness to maintain transferability relative to the recording paper after drying compared with ink used in a line type recording head which effects printing directly on the recording paper. Thus, bubbles are more likely to stagnate in pressure producing chambers, nozzle openings and other portions of the head. Stagnated bubbles can cause clogging and undesirable performance.

To eliminate nozzle clogging, a recording head has been proposed in Japanese Patent Unexamined Publication No. 123672/1984 in which common ink flow paths are arranged interposed between the pressure producing chambers, an ink supply inlet and an ink discharge outlet are disposed at one end of the ink flow paths, and a pressure difference is produced between the flow path points to circulate the ink in the pressure producing chambers.

Such ink circulation can prevent nozzle clogging to some extent, but if the length of the recording head is of the same order as the recording paper width, clogging of the nozzle opening remote from the ink supply inlet and the ink discharge outlet cannot be eliminated sufficiently.

SUMMARY OF THE INVENTION

The invention has been made in view of the above problems. Accordingly, an object of the invention is to provide a printer using a line-type ink jet recording head capable of reliably preventing clogging and eliminating bubbles, even in a long ink jet recording head such as a line-type head.

To achieve the above object, the invention is applied to a printer using a line-type ink jet recording head having a line head which has pressure producing chambers formed by dividing nozzle openings extending in a recording paper width direction with vertical side walls, and an upper ink flow path and a lower ink flow path which communicate with each other through the pressure producing chambers and extend in a horizontal direction. Each flow path has an inlet for replenishing ink, an outlet for discharging the ink on both ends thereof, and a plurality of pressure producing elements for applying varied pressures to the pressure producing chambers for jetting ink droplets. A sealing member is provided for sealing the nozzle openings by abutting on the nozzle openings when the recording head has been evacuated to a predetermined position. An ink tank is connected to the inlets and the outlets through pipes, and an ink stream producing device is arranged in the pipes for producing streams causing the ink at least to enter from the ink tank to the lower ink flow path and then to the upper ink flow path and the ink tank via the pressure producing chambers.

If a stream flowing from the lower ink flow path into the upper ink flow path and into the ink tank via the pressure producing chambers is produced by the ink stream producing device with the nozzle openings being sealed by the sealing member at the time of loading the ink, then any bubbles which form adjacent to the pressure producing chambers are decomposed into tiny bubbles by a horizontally flowing component of the stream, and the tiny bubbles are forced out into the upper flow path by the ink stream flowing upward in the pressure producing chambers to be driven out of the recording head.

DESCRIPTION OF THE PREFERRED EMBODIMENTS

Embodiments of the invention will now be described in detail with reference to the accompanying drawings.

Figure 1:
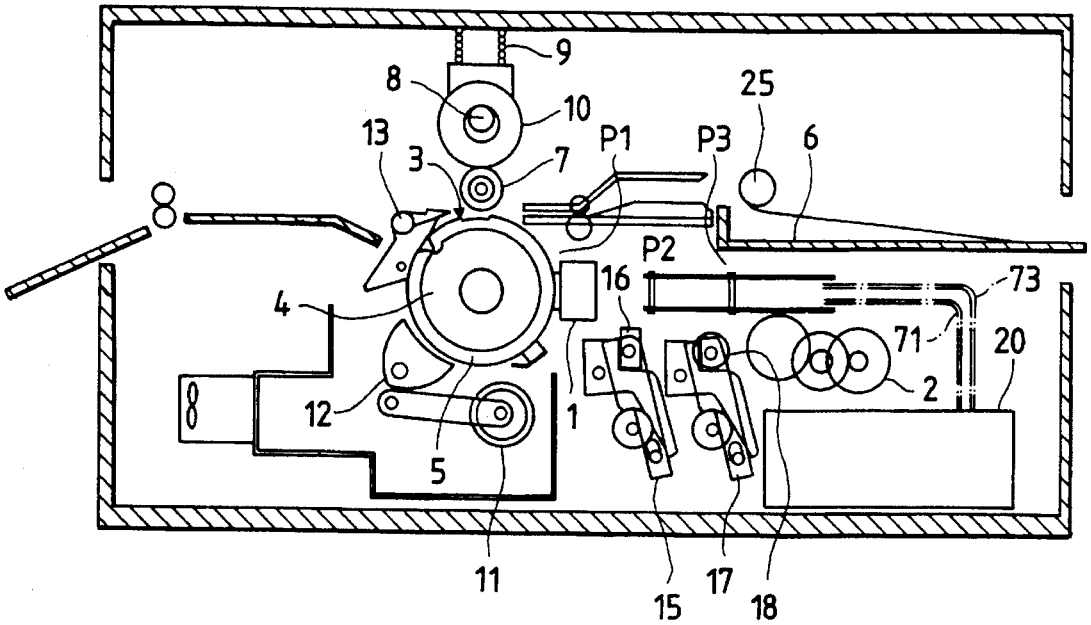
FIG. 1 is a sectional view showing a transfer type ink jet printer of a preferred embodiment of the invention.

FIG. 1 shows a transfer type ink jet recording apparatus constructed according to a preferred embodiment of the invention. The head 1 is carried on a drive mechanism 2 so that the head can move to a print position P1, a jetting ready position P2, and a capping position P3. Ink image holding drum 3 is arranged so as to confront the line recording head 1. The ink image holding drum 3 prevents the ink from seeping onto the surface of a drum 4 that is driven by a drive mechanism (not illustrated) at a predetermined rotational speed. The ink image holding drum 3 is formed by coating an ink image holding layer 5 around the outer surface of the drum 4. The layer 5 is formed of a material, such as silicone rubber, which is free from blots and which is excellent in transferring ink to recording paper. A pressure roller 7 causes the recording paper fed out of a cassette 6 to come into pressurized contact with the ink image holding drum 3. The pressure roller 7 which is supported about an eccentric shaft 8, is evacuated to an upper position at the time an ink image is formed, and is lowered during a transfer operation while abutting a backup roller 10 that is biased by a spring 9.

Also, a drum cleaner 11 for removing the remaining ink, a heater 12 for promoting the drying of the ink image, and a separating mechanism 13 for separating the recording paper from the drum surface are disposed around holding drum 3.

A capping member 15, which seals the nozzle openings with a cap 16, is being driven when the recording head 1 has been evacuated to a position P2, and a sealing mechanism 17 seals the nozzle openings with a sealing member 18 made of, e.g., rubber, when the recording head 1 has been evacuated to position P3.

The supply unit 20, which is connected to the recording head 1 through a plurality of soft tubes 71, 73, supplies ink to the recording head 1 from an ink tank and recovers the ink and impurities from the recording head 1.

Figure 2:
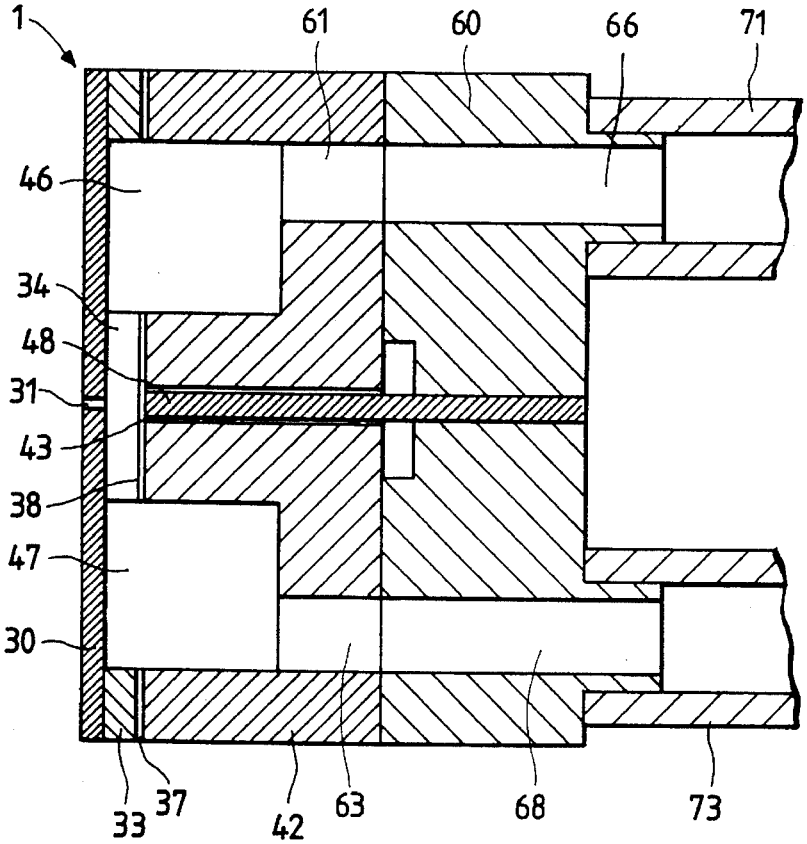
FIG. 2 is a sectional view showing an exemplary ink jet recording head applied to the printer shown in FIG. 1.
Figure 3:
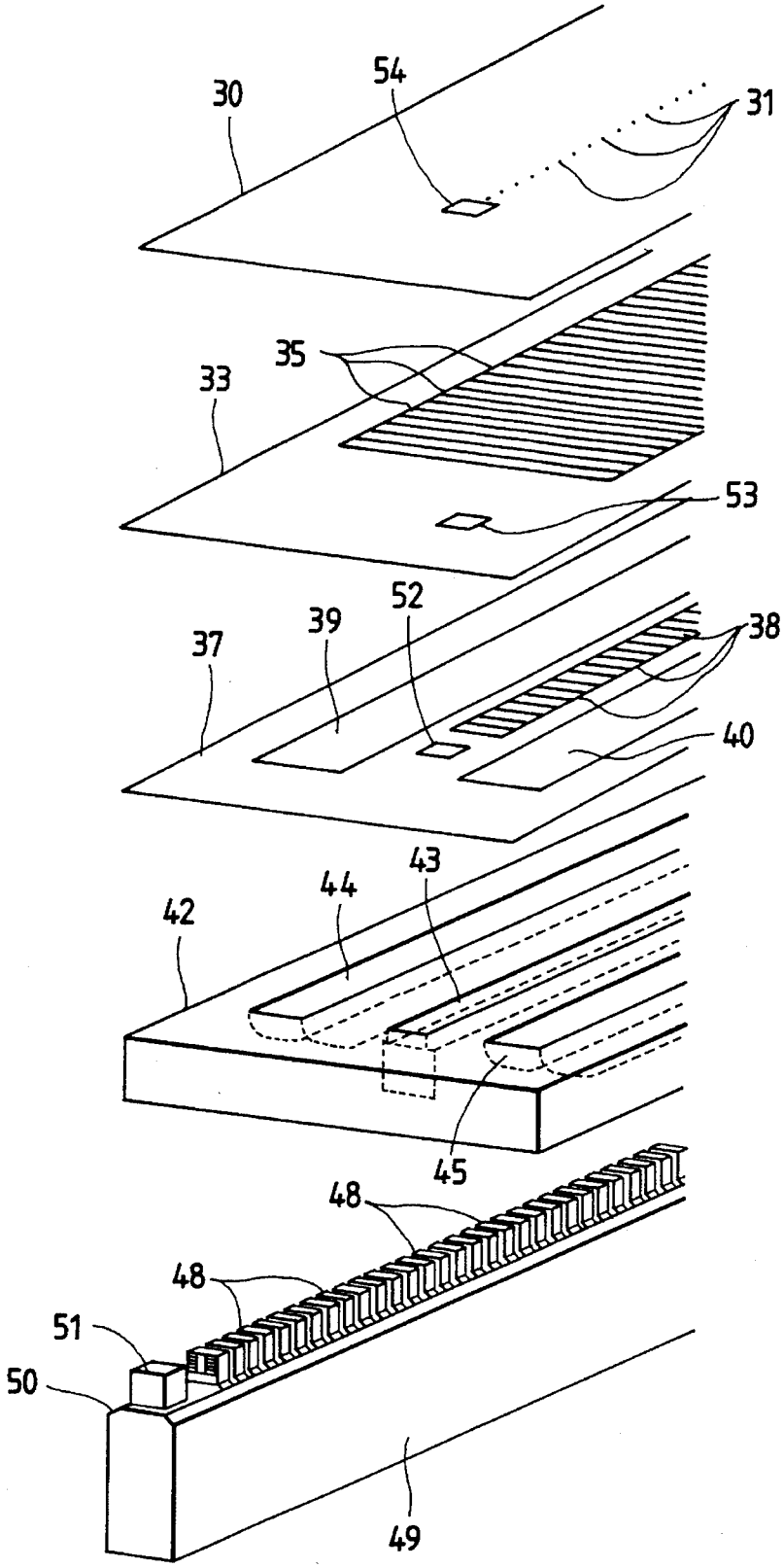
FIG. 3 is an exploded perspective view of the ink jet recording head shown in FIG. 2.
Figure 4:
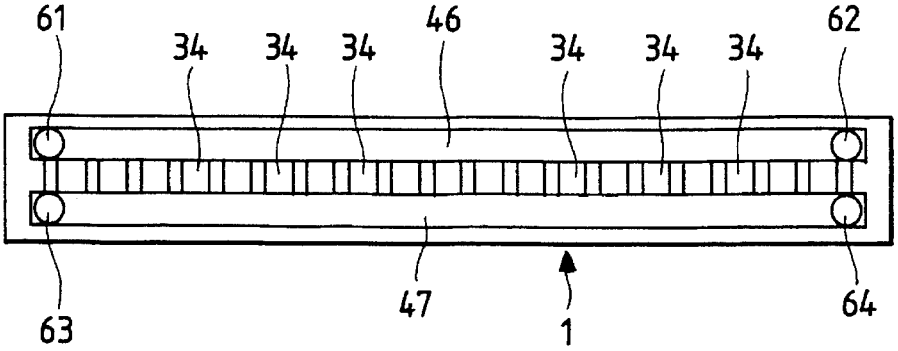
FIG. 4 is a front view of the recording head showing the structure of pressure producing chambers and ink flow paths with a nozzle plate thereof removed.

FIGS. 2, 3, and 4 illustrate the recording head 1. A nozzle plate 30 has a plurality, e.g., 2000, nozzle openings 31, 31, 31, . . . arranged linearly or vertically staggered, so that recording on recording paper having a large width can be accomplished. A recording head having a plurality of nozzles, e.g., 400 nozzles, arranged at a pitch of five dots in the line direction can be used so that an ink image corresponding to a single page can be formed by, e.g., five revolutions of the ink image holding drum 3 while moving the recording head by a distance corresponding to a single dot every revolution of the ink image holding drum.

A spacer 33 has through-holes 35, 35, 35, . . . for forming pressure producing chambers 34, 34, 34, . . . that are juxtaposed at equal intervals in the horizontal direction so as to partition the adjacent nozzle openings when set on the printer.

A vibrating plate forming member 37 has a portion thereof confronting the pressure producing chamber 34, which is formed into a thin portion 38. In portions of the vibrating plate forming member which confront the ink flow paths 46, 47 (described later) are formed through-holes 39, 40, which are thin, long, and rectangular in shape and are arranged on respective sides of the thin portions 38.

An ink supply flow path forming member 42 has a vibrating element unit through-hole 43 formed therein through which piezoelectric vibrating elements 48, 48, 48, . . . of a vibrating element unit 50 pass. Long grooves 44, 45 are formed in the ink supply path forming member 42 in portions thereof which oppose the ink flow paths 46 and 47, respectively.

The piezoelectric vibrating elements 48 are formed by sandwiching electrodes and a piezoelectric vibrating material so that vibrations are produced by a smallest possible drive voltage in a vertical vibrating mode. The number of piezoelectric vibrating elements corresponds to the number of nozzle openings 31, 31, 31, . . . The piezoelectric vibrating elements are fixed on a substrate 49 to form the vibrating element unit 50. Art end of each of the piezoelectric vibrating elements 48, 48, 48, . . . is inserted into a respective vibrating element unit through-hole 43 of the ink supply flow path forming member 42 so as not to come in contact therewith and fixed on each of the thin portions 38, 38, 38, . . . of the vibrating plate forming member 37. A positioning projection 51 is formed on the substrate 49. The projection 51 passes through the vibrating element unit through-hole 43 of the ink supply flow path forming member 42 so as to ensure accuracy in positioning the respective members with respect to positioning holes 52, 53, 54 arranged on the vibrating plate forming member 37, the spacer 33, and the nozzle plate 30.

An ink flow path connecting member 60 connects through-holes 61, 62, 63, 64 to tubes 71, 72, 73, 74 connecting an ink supply unit (described below). The through-holes 61, 62, 63, 64 are arranged on both ends of the long grooves 44, 45 of the ink supply flow path forming member 24 (see FIGS. 2 and 4).

The upper ink flow path 46 and the lower ink flow path 47 provide communication between the pressure producing chambers 34, 34, 34, . . . extending in the recording paper width direction. Since the recording head 1 is long (e.g., 250 mm) compared with a conventional recording head, the cross-sectional area of each of the ink flow paths 46, 47 is large (e.g., 2 mm×2 mm) so that the ink can flow therethrough smoothly. At least on both ends of the ink flow paths 46, 47 are located the through-holes 61, 62, 63, 64 that communicate with the ink tank.

Figure 5:
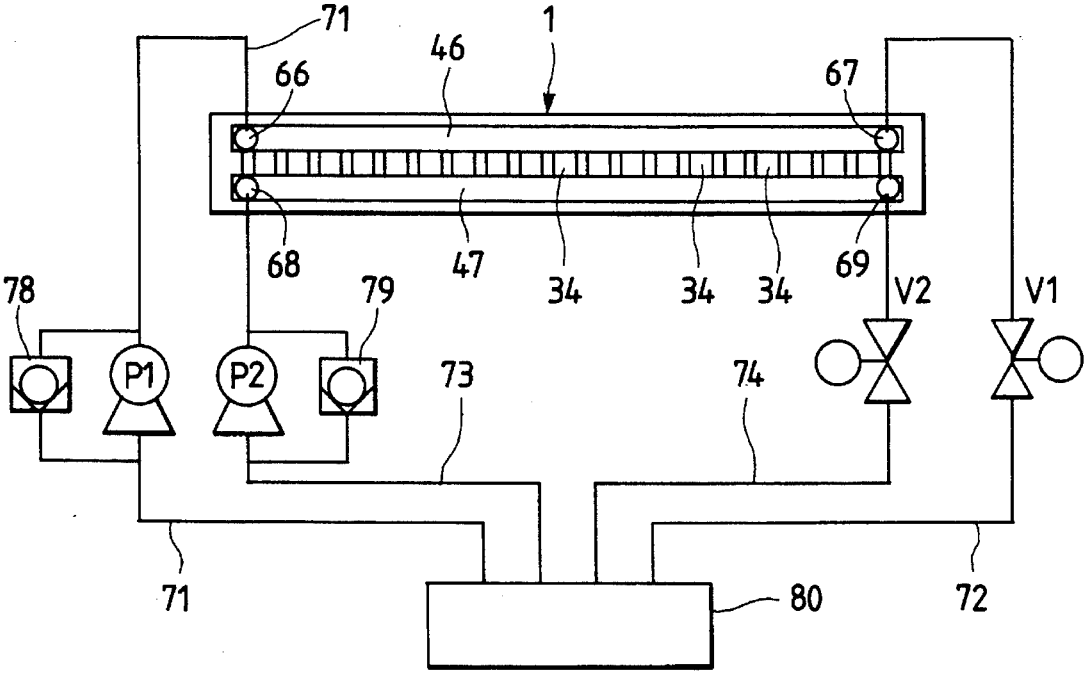
FIG. 5 is a diagram showing an exemplary flow path configuration of the preferred embodiment.

FIG. 5 is a diagram showing the flow path configuration of the ink supply unit to which the preferred embodiment is applied. One connecting end 66 of the upper flow path 46 is connected to a pump P1 through the tube 71, whereas one connecting end 68 of the lower ink flow path 47 is connected to a pump P2 through the tube 73. The other connecting end 67 of the tapper ink flow path 46 is connected to an electromagnetic value V1 through the tube 72. The inlets of these pumps P1, P2 and the other ends of the electromagnetic valves V1, V2 are connected to the common ink tank 80. Check valves 78 and 79 are connected in parallel with the pumps P1, P2, respectively, so as to by-pass the pumps P1, P2 for providing the ink flow paths during printing.

Figure 7A:
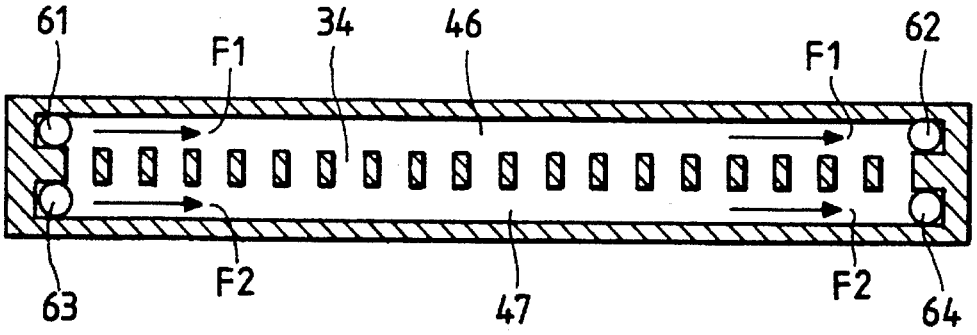
FIGS. 7(A) and 7(B) are diagrams for describing ink streams when ink is loaded.
Figure 7B:
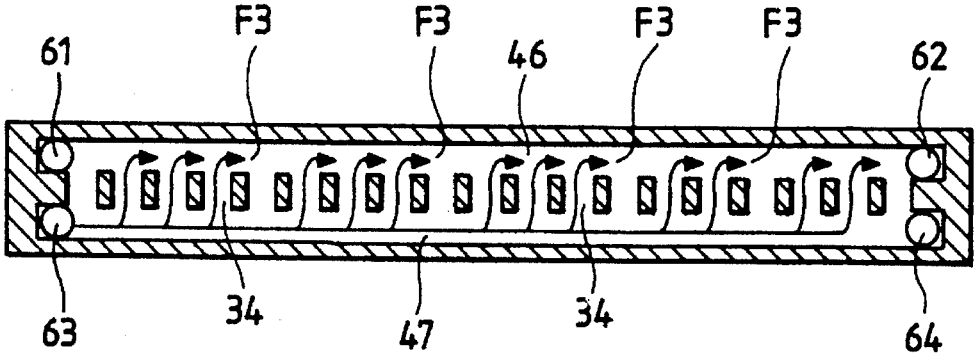

The operation of the preferred embodiment will be described with reference to FIGS. 7A and 7B.

Initial loading is required if the ink is not fully loaded into the recording head 1, such as when the tank 80 is loaded because the ink in the tank has depleted, or when the recording head 1 is replaced.

The first operation is to evacuate the recording head 1 to the predetermined position P3 (FIG. 1) and to seal the nozzle openings 31, 31, 31, . . . by causing the sealing member 10 to abut against the front surface of the recording head 1. When the first and second pumps P1, P2 are operated by opening the first and second valves V1, V2, the ink supplied by the pumps P1, P2 from the ink tank 80 flows into the through-holes 61, 63, which are arranged on one end of the recording head 1, flows through the respective ink flow paths 46, 47 substantially in a parallel manner, and returns to the ink tank 80 via the tubes 72, 74 from the through-holes 62, 64, which are arranged on the other end thereof.

In this process, the ink entering the through-hole 61 flows mainly to the ink flow path 46 that communicates therewith, whereas the ink entering the through-hole 63 flows mainly to the ink flow path 47 that communicates therewith. If there is a difference in pressure between the ink flow paths 46, 47 during this process, part of the ink flow is branched while passing through the pressure producing chambers 34, 34, 34, . . . that connect the ink flow path 46 to the ink flow path 47. Because the main streams F1, F2 (FIG. 7A) run parallel through the respective ink flow path 46, 47, a large volume of air present in the ink flow paths 46, 47 and the pressure producing chambers 34, 34, 34, . . . is discharged efficiently to the ink tank 80. The air discharged to the ink tank 80 is released into the atmosphere through an outlet of the tank.

Figure 6:
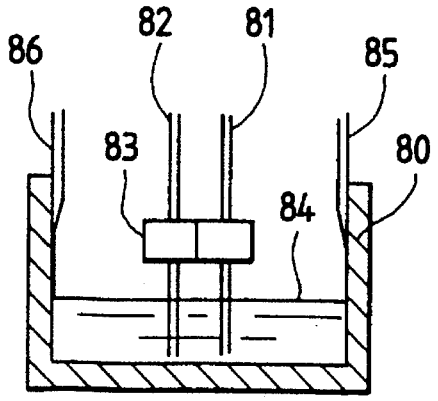
FIG. 6 is a sectional view showing an exemplary ink tank.

As shown, in FIG. 6, the tubes 71, 73 connected to the pumps P1, P2 are connected to inlet pipes 81, 82, respectively, the lower ends of which are positioned below the ink level 84. The inlet pipes 81, 82 have a filter 83. Ends of discharge pipes 85, 86 connected to the tubes 72, 74 are arranged so as to extend along the side walls of the ink tank 80.

As a result of this construction, a relatively easily foamable ink containing a surface-active agent can flow into the ink surface 84 along the wall surfaces of the tank 80, thereby allowing the ink to be recovered to the tank 80 without foaming. An example of such ink includes the following components.

| | |
|---|---|
| Pigment | 3 wt % |
| Emulsion | 12 wt % |
| Triethanolamine | 5 wt % |
| Polyethylene glycol | 5 wt % |
| Isopropyl glycol | 5 wt % |
| Surface-active agent | 2 wt % |
| Water | 69 wt % |

When a predetermined amount of ink has been circulated within the recording head 1, the pump P1 connected to the upper ink flow path 46 is stopped and the electromagnetic valve V2 connected to the lower ink flow path 47 is closed. As a result, the ink having entered to the lower ink flow path 47 from the pump P2 is now returned to the ink tank 80 via the through-hole 62 while producing branches F3 in the ink flow (FIG. 7B) which extend to the upper ink flow path 46 via the pressure producing chambers 34, 34, 34, . . . due to the pressure differences in ink flow paths 46 and 47.

The above described horizontal and vertical flows in the ink flow paths 46, 47 contribute to decomposing bubbles of relatively large size which stagnate near the pressure producing chamber at the time of initial loading. Such decomposition takes place as the bubbles are greatly reduced in size by edges of the pressure producing chambers 34, 34, 34, . . . in the course of moving in the horizontal stream. These tiny bubbles move smoothly to the upper ink flow path 46 encouraged by the stream directed toward the upper ink flow path 46 as well as by their own buoyancy. Then, the bubbles are discharged to the ink tank 80 from the through-hole 62 while riding on the streams of the ink moving through the upper ink flow path 46.

When the operation of the pumps P1, P2 is stopped and a print signal is applied to the recording head 1 with the electromagnetic valves V1, V2 opened after the loading of the ink has been completed, a pressure producing chamber 34 is contracted by the corresponding piezoelectric vibrating element 48, causing the ink present in the pressure producing chamber 34 to be jetted out in the form of an ink droplet onto the ink image holding drum 3. As the pressure producing chamber 34 recovers its original condition by expansion after the ink jetting operation has been completed, the ink flows into the pressure producing chamber 34 from the two ink flow paths 46, 47 disposed on respective sides of the pressure producing chamber 34 so that the pressure producing chamber 34 is ready for printing a next dot.

As an ink image for a predetermined amount of data has been formed in this way, moisture that is contained in the ink is volatilized in the air, forming an adhesive film on the surface of the ink image. At this point, a sheet of recording paper is taken out of a sheet feed cassette 6, causing the sheet to abut against the ink image holding drum 3 and moving the record paper so as to be in pressure contact therewith by applying pressure to the back surface of the record paper using the pressure roller 7. The ink image is thus transferred onto the recording paper due to its own adhesiveness (see FIG. 1).

Connecting ends 66, 68 of the ink flow paths 46, 47 communicate with the ink tank 80 through the check valves 78, 79, and connecting ends 67, 69 communicate with the ink tank 80 through the electromagnetic valves V1, V2, so that ink flow paths from the tank 80 to the ink flow paths 46, 47 are defined. As a result, the ink is supplied smoothly from both sides of the recording head 1 by the siphoning action of pressure producing chambers 34 so that the amount of ink consumed by the jetting of ink droplets can be replenished.

If the nozzle openings 31, 31, 31, . . . are clogged due to printing over a long period of time, the pumps P1, P2 can be driven while closing the electromagnetic valves V1, V2. Then, the ink is supplied from the tank 80 to the flow paths 46, 47. Since the other ends of through-holes 62, 64 are closed, the delivery pressure of the pumps P1, P2 acts on all the nozzle openings 31, 31, 31, . . . to drive ink film and debris, which is the source of the clogging, from the nozzle openings 31, 31, 31, . . . After the clogging of the nozzle openings 31, 31, 31 . . . is removed in this manner, the roller of a cleaning member is abutted on the nozzle openings 31, 31, 31, . . . to wipe off the ink film and debris from the nozzle openings 31, 31, 31, . . . , as well as overflowing ink (see FIG. 1).

When the viscosity of the ink present adjacent to the nozzle openings 31, 31, 31, . . . is increased by volatilization of a solvent contained in the ink, the recording head 1 is evacuated to capping position P2 from the ink image holding drum 3 and the recording head 1 comes in contact with the capping member 15, which is movable. When air at a gauge pressure of about 0.2 kg is supplied into the cap 16 under this condition, the pressure acts on the nozzle openings 31, 31, 31, . . . , causing the ink and film present in the cap to be bounced back to the pressure producing chambers 34, 34, 34, . . . When a predetermined time has elapsed, the supply of the air is stopped and the capping member 15 is thereafter removed, then new ink in the pressure producing chambers 34, 34, 34, . . . moves to the nozzle openings 31, 31, 31, . . . by surface tension to thereby form a meniscus so that the nozzle openings are ready to jet ink droplets.

If bubbles enter during the ink recovering process, the bubbles can be discharged from the ink flow paths 46, 47 and the pressure producing chambers 34, 34, 34, . . . by the above-described operation. Although the debris and the ink films having entered due to the ink jet recovering operation flow into the ink tank 80 together with the ink, they are removed by a filter 83 when the ink is supplied to the recording head 1. Thus, the flow of the debris and the like does not adversely affect printing.

While ink replenishment at the time of printing is ensured by the check valves 78, 79 connected in parallel with the pumps P1, P2 in this embodiment, it is apparent that similar effects can be obtained by connecting the electromagnetic valves in parallel with the pumps P1, P2 and controlling the device so that the electromagnetic valves will be opened at the time of printing.

Figure 8:
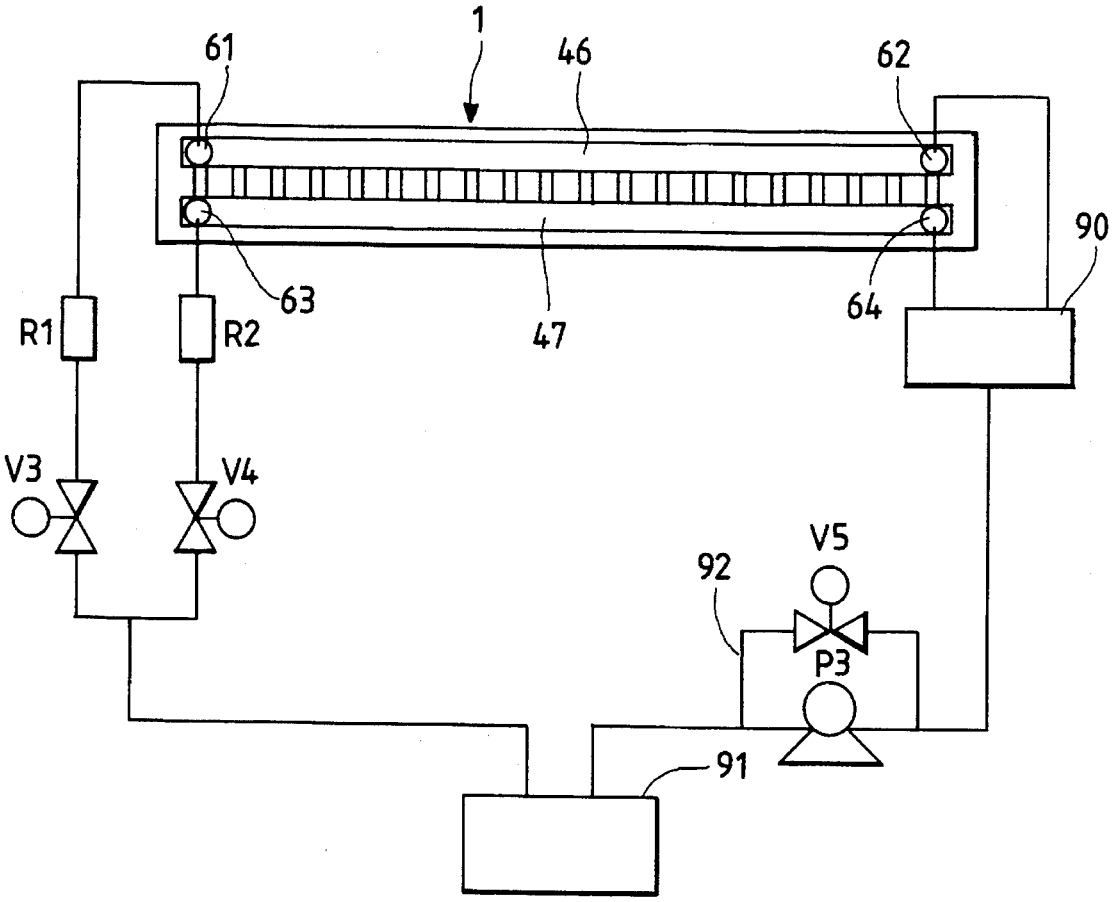
FIG. 8 is a diagram showing another flow path configuration of the second preferred embodiment.

FIG. 8 shows a second embodiment of the invention. The through-holes 62, 64 are respectively arranged at connecting ends of the ink flow paths 46, 47 of the recording head 1 and are connected to a pump P3 for supplying the ink from an ink tank 91 through a common buffer tank 90. The other connecting ends 61, 63 of the ink flow paths 46, 47 are connected to electromagnetic valves V3, V4 through flow resistors R1, R2 (described below) to communicate with the ink tank 91.

The flow resistors R1, R2 are set to values such that a flow rate large enough to discharge bubbles in the flow paths 46, 47 can be ensured, and such that the total resistance of the upper ink flow path 46 can be made smaller than the total resistance of the lower ink flow path 47. An electromagnetic valve V5 is connected to a bypass pipe 92 that is connected to the inlet and outlet of the pump P3. The bypass pipe serves to provide ink supply paths at the time of printing.

In this embodiment, when the pump P3 is driven with the nozzle openings 31, 31, 31, . . . sealed, the electromagnetic valves V3, V4 opened, and the electromagnetic valve V5 closed, the ink is supplied from the ink tank 91 to the flow paths 46, 47 through the buffer tank 90.

Figure 9:
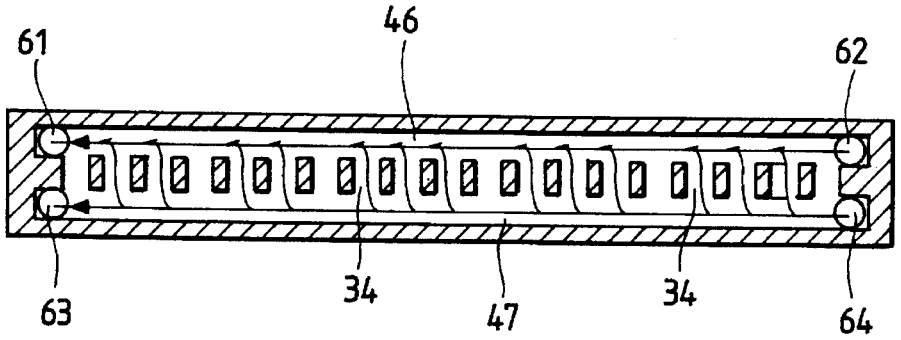
FIG. 9 is a diagram for describing ink streams when ink is loaded in the configuration shown in FIG. 8.

Since the total resistance of the upper ink flow path 46 is smaller than that of the lower ink flow path 47, the ink flow entering the lower ink flow path 47 is bifurcated. That is, one stream flows toward the connecting end 63 on the other side, whereas the other stream flows toward the connecting end 61 on the other side of the upper flow path 46 while flowing into the upper flow path 46 via the pressure producing chambers 34, 34, 34 . . . (FIG. 9). The ink discharged from the connecting ends 61, 63 returns to the ink tank 91 via the flow resistors R1, R2 and the electromagnetic valves V3, V4.

These two streams, the one running parallel to the ink flow paths 46, 47 and the other directed upward through the pressure producing chambers 34, 34, 34, . . . , allow any bubbles which are in the ink flow paths 46, 47 and the pressure producing chambers 34, 34, 34, . . . to be discharged to the ink tank 91 with the bubbles being first decomposed and then forced out into the upper ink flow path 46.

To start printing after the ink has been filled in the recording head 1, the pump P3 is stopped and the electromagnetic valves V3, V4 and V5 are opened, so that the ink flow paths 46, 47 of the recording head 1 communicate with the ink tank 91 through the through-holes 61, 62, 63, 64 on both ends of the recording head 1, thereby allowing the consumed ink to be replenished smoothly.

When the nozzle openings 31, 31, 31, . . . have been clogged due to printing over a long period of time, the pump P3 is driven by evacuating the recording head 1 to a predetermined position and closing the electromagnetic valves V3, V4 and V5. As a result, ink pressure is applied to the pressure producing chambers 34, 34, 34, . . ., thus allowing the clogging of the nozzle openings 31, 31, 31, . . . to be eliminated.

While the flow resistors R1, R2 are connected to the outer side of the recording head 1 in this embodiment, they may be arranged within the recording head itself by providing a narrowed portion in the connecting ends 61, 63 of the upper and lower flow paths 46, 47 of the recording head 1.

While a transfer-type ink jet printer has been described in the above embodiment, it is apparent that the invention provides similar advantages when applied to printers wherein printing is done directly on recording paper. While piezoelectric vibrating elements produce ink droplets in the above embodiment, it is apparent that the invention can provide similar advantages when applied to a line head using heating elements or other appropriate devices.

As described above, the invention allows bubbles in the pressure producing chambers to be decomposed so as to be reliably driven out from within the recording head by their own buoyancy, as well as by ink streams which flow upward in the pressure producing chambers.

What is claimed is:

1. A printer having a line-type ink jet recording head, comprising:

a line head extending substantially horizontally in a recording paper width direction and having pressure producing chambers defined therein by substantially vertical side walls, at least one nozzle opening formed in each of said pressure producing chambers, an upper ink flow path and a lower ink flow path defined in said line head above and below said pressure producing chambers, respectively, said upper and said lower ink flow path being in fluid communication with each other through the pressure producing chambers and extending substantially horizontally, each said ink flow path having an inlet for replenishing ink and an outlet for discharging the ink on respective ends thereof, and a plurality of pressure producing elements coupled to said pressure producing chambers for applying varied pressures to the pressure producing chambers for jetting ink droplets;

a sealing member for sealing the nozzle openings by abutting on the nozzle openings when the recording head has been evacuated to a predetermined position;

an ink tank connected to said inlets and said outlets by pipes; and ink stream producing means, associated with said pipes, for producing streams of ink flow, wherein the ink flows from said ink tank to at least said lower ink flow path and then to said upper ink flow path through the pressure producing chambers before returning to said tank.

2. A printer as claimed in claim 1, wherein said ink stream producing means comprises means for producing a first stream of ink flow and a second stream of ink flow which respectively flow through said upper ink flow path and said lower ink flow path in a horizontal direction, and a third stream of ink flow which flows from said lower ink flow path to said upper ink flow path through said pressure producing chambers.

3. A printer as claimed in claim 2, wherein said ink stream producing means further comprises pumping means for pumping a fluid, said pumping means being connected between said ink tank and said inlets on the ends of said upper ink flow path and said lower ink flow path, and valve means for regulating flow of a fluid, said valve means being connected between said ink tank and said outlets on the other ends of said upper ink flow path and said lower ink flow path.

4. A printer as claimed in claim 3, further comprising bypass means, for allowing the upper ink flow path and the lower ink path to communicate with the ink tank at the time of printing, connected to the pumping means.

5. A printer using an ink jet type line recording head according to claim 1, wherein said ink stream producing means comprises pumping means for pumping a fluid, said pumping means being connected between said ink tank and said inlets on ends of said upper ink flow path and said lower ink flow path, and flow resistor means for creating a first fluid resistance in an ink flow path forming member communicating with said outlet of said lower ink flow path, said first fluid resistance being greater than a second fluid resistance of an ink flow path forming member communicating with said outlet of said upper ink flow path.

6. A printer as claimed in claim 5, further comprising bypass means, for allowing said upper ink flow path and said lower ink flow path to communicate with said ink tank during a printing operation, connected to said pumping means.

7. A printer as claimed in claim 3, wherein said valve means is connected to said outlets of said upper ink flow path and said lower ink flow path to apply ink delivery pressure to said nozzle openings when said valve means is closed.

8. A printer as claimed in claim 3, wherein said valve means is connected to said outlets of said upper ink flow path and said lower ink flow path to apply ink delivery pressure to the nozzle openings when said valve means is closed.

9. A printer as claimed in claim 4, wherein said valve means is connected to said outlets of said upper ink flow path and said lower ink flow path to apply ink delivery pressure to the nozzle openings when said valve means is closed.

10. A printer as claimed in claim 5, wherein said valve means is connected to said outlets of said upper ink flow path and said lower ink flow path to apply ink delivery pressure to the nozzle openings when said valve means is closed.

11. A printer as claimed in claim 6, wherein said valve means is connected to said outlets of said upper ink flow path and said lower ink flow path to apply ink delivery pressure to the nozzle openings when said valve means is closed.

12. A printer as claimed in claim 1, wherein a filter member is connected to the pipes supplying the ink from said ink tank to said line recording head.

13. A printer as claimed in claim 2, wherein a filter member is connected to the pipes supplying the ink from said ink tank to said line recording head.

14. A printer as claimed in claim 3, wherein a filter member is connected to the pipes supplying the ink from said ink tank to said line recording head.

15. A printer as claimed in claim 4, wherein a filter member is connected to the pipes supplying the ink from said ink tank to said line recording head.

16. A printer as claimed in claim 5, wherein a filter member is connected to the pipes supplying the ink from said ink tank to said line recording head.

17. A printer as claimed in claim 6, wherein a filter member is connected to the pipes supplying the ink from said ink tank to said line recording head.

18. A printer as claimed in claim 7, wherein a filter member is connected to the pipes supplying the ink from said ink tank to said line recording head.

19. A printer as claimed in claim 1, wherein ends of said pipes for returning the ink from said line recording head to said ink tank are arranged so as to come in contact with wall surfaces of said ink tank.

20. A printer as claimed in claim 2, wherein ends of said pipes for returning the ink from said line recording head to said ink tank are arranged so as to come in contact with wall surfaces of said ink tank.

21. A printer as claimed in claim 3, wherein ends of said pipes for returning the ink from said line recording head to said ink tank are arranged so as to come in contact with wall surfaces of said ink tank.

22. A printer as claimed in claim 4, wherein ends of said pipes for returning the ink from said line recording head to said ink tank are arranged so as to come in contact with wall surfaces of said ink tank.

23. A printer as claimed in claim 5, wherein ends of said pipes for returning the ink from said line recording head to said ink tank are arranged so as to come in contact with wall surfaces of said ink tank.

24. A printer as claimed in claim 6, wherein ends of said pipes for returning the ink from said line recording head to said ink tank are arranged so as to come in contact with wall surfaces of said ink tank.

25. A printer as claimed in claim 7, wherein ends of said pipes for returning the ink from said line recording head to said ink tank are arranged so as to come in contact with wall surfaces of said ink tank.

26. A printer as claimed in claim 8, wherein ends of said pipes for returning the ink from said line recording head to said ink tank are arranged so as to come in contact with wall surfaces of said ink tank.

* * * * *